US007118453B2

(12) United States Patent
Hori et al.

(10) Patent No.: US 7,118,453 B2
(45) Date of Patent: Oct. 10, 2006

(54) WORKPIECE GRINDING METHOD

(75) Inventors: Nobumitsu Hori, Ichinomiya (JP); Kazuo Tabuchi, Takahama (JP); Mamoru Katsuta, Kariya (JP); Yoichi Ito, Kariya (JP)

(73) Assignee: Toyoda Koki Kabushiki Kaisha, Kariya (JP)

( * ) Notice: Subject to any disclaimer, the term of this patent is extended or adjusted under 35 U.S.C. 154(b) by 0 days.

(21) Appl. No.: 11/245,069

(22) Filed: Oct. 7, 2005

(65) Prior Publication Data

US 2006/0116052 A1 Jun. 1, 2006

(30) Foreign Application Priority Data

Nov. 29, 2004 (JP) ..... 2004-343744

(51) Int. Cl.
*B24B 49/00* (2006.01)

(52) U.S. Cl. ..... 451/11; 451/57

(58) Field of Classification Search ..... 451/11, 451/12, 14, 57, 58, 65, 5, 49, 249
See application file for complete search history.

(56) References Cited

U.S. PATENT DOCUMENTS 4,603,514 A 8/1986 Suzuki et al.
4,619,083 A 10/1986 Akabane et al.
6,306,018 B1 * 10/2001 Coverdale et al. ..... 451/49
6,511,364 B1 * 1/2003 Ido et al. ..... 451/49

FOREIGN PATENT DOCUMENTS

DE 2 320 339 10/1974
JP 54-296 1/1979

* cited by examiner

*Primary Examiner*—Dung Van Nguyen
(74) *Attorney, Agent, or Firm*—Oblon, Spivak, McClelland, Maier & Neustadt, P.C.

(57) ABSTRACT

In a workpiece grinding method, a grinding allowance of a predetermined width (T) at at least an end surface portion 21 of a workpiece W is removed with a grinding wheel 10 (or 32) by rotating the workpiece W having a cylindrical portion 20 and the end surface portion 21 perpendicular thereto, by rotating the grinding wheel 10 (or 32) supported rotatably about an axis extending in parallel with the axis of the workpiece 10 (or 32), and by moving the grinding wheel 10 (or 32) relatively to the workpiece W. The method comprises a first grinding step of grinding the end surface portion 21 to an approximately right triangle shape in section by infeeding the grinding wheel 10 (or 32) from a grinding start position (S), where the grinding wheel 10 (or 32) overlaps the circumferential surface of the end surface portion 21 through the predetermined width (T) or a narrower width, toward an infeed end position (E) on the side of the cylindrical portion 20 in an oblique XZ-direction; and a second grinding step of removing a grinding allowance of the approximate right triangle shape in section left without being ground at the first grinding step, by feeding the grinding wheel 10 (or 32) in an approximately axial direction of the workpiece W.

9 Claims, 8 Drawing Sheets

FIRST PRIOR ART

SECOND PRIOR ART

WORKPIECE GRINDING METHOD

INCORPORATION BY REFERENCE

This application is based on and claims priority under 35 U.S.C. 119 with respect to Japanese Application No. 2004-343744 filed on Nov. 29, 2004. The contents of that application are incorporated by reference in its entirety.

BACKGROUND OF THE INVENTION

1. Field of the Invention

The present invention relates to a grinding method, and in particular, it relates to a workpiece grinding method which takes as an object to be ground a workpiece having a cylindrical portion and an end surface portion perpendicular thereto and which is practiced in removing a grinding allowance of a predetermined width at at least the end surface portion with a grinding wheel.

2. Discussion of the Related Art

A grinding method illustrated in FIG. 8(*a*) has been known as one for grinding a workpiece W such as crankshaft or the like, that is, the workpiece W having a cylindrical portion 42, end surface portions 43 (called also as flanged surface portion) perpendicular to the cylindrical portion 42 and rounded corners 44 adjoining the end surface portions 43 with the cylindrical portion 42. In the known grinding method, there is used a grinding wheel 41 having a grinding wheel layer which coincides in shape with a finished shape (indicated by the two-dot-chain line) of the workpiece W, and a plunge grinding is performed to grind the cylindrical portion 42, the end surface portions 43 and the rounded corners 44 of the workpiece W at a time.

However, in the aforementioned grinding method, since shoulder portions 45 only of the grinding wheel 41 work to grind the end surface portions 43 of the workpiece W, the grinding amount per unit area which is removed by each of the shoulder portions 45 of the grinding wheel 41 is increased, whereby the shoulder portions 45 of the grinding wheel 41 suffer local wear as indicated for example by the two-dot-chain line. As a consequence, because the shoulder portions 45 of the grinding wheel 41 are large in wear, the grinding wheel 41 has to be trued frequently though a circumferential surface portion 46 thereof remains alive to serve yet. This results in shortening the service life of the grinding wheel 41.

To overcome the aforementioned problem, there has been proposed another grinding method illustrated in FIG. 8(*b*). This method is implemented by using a grinding wheel 48 which is narrower in width than the cylindrical portion 42 of the workpiece W and by moving the grinding wheel 48 in the axial direction while effecting a plunge feed of the grinding in the radial direction of the workpiece W, that is, by effecting the oblique feeding as indicated by the arrow A, so that either one of the end surface portions 43, the rounded corner 44 and the external surface of the cylindrical portion 42 are ground simultaneously. In this method, it becomes possible to decrease the wear of each shoulder portion 49 because the grinding amount per unit area removed by each shoulder portion 49 is decreased. For this reason, in this latter grinding method, the local wear at each shoulder portion 49 is decreased, and therefore, it can be realized to suppress the frequent executions of the truing operation. In addition, because of the simultaneous grindings of the end surface portion 43, the rounded corner 44 and the cylindrical portion 42, it becomes possible to shorten the machining time.

However, in the latter mentioned prior art grinding method illustrated in FIG. 8(*b*), the performance of discharging grinding chips is deteriorated because the surface contact takes place between each end surface portion 43 of the workpiece W and the corresponding end surface portion 50 of the grinding wheel 48 and because the contact arc of the grinding wheel 48 brought into contact with the end surface portion 43 is lengthened in the rotational direction. This brings about a cause to plug pores of the grinding wheel 48 with the grinding chips and hence, to increase the grinding heat generation. In particular, in the case of the grinding heat generation being excessive, not only grinding burns but also local expansion is brought about on the workpiece W, whereby it becomes impossible to secure the perpendicularity of the end surface portion 43 to the cylindrical portion 42.

Further, the cooling performance is also lowered because the surface contact between the end surface portion 50 of the grinding wheel 48 and the end surface portion 43 of the workpiece W makes it difficult for coolant fluid reach the ground surface being heated. In other words, the deterioration in the cooling performance expedites the increase of the heat generation, so that it becomes difficult to enhance the grinding efficiency (the workpiece volume removed during a unit time period) by, for example, making the grinding speed faster. Where the truing interval is set to be shorter as alternative, it may become possible to suppress the grinding burn to some extent even in the case of a grinding operation at an enhanced grinding efficiency. However, the alternative undesirably results not only in a higher tool cost but also in work increase for the frequent grinding wheel exchanges.

SUMMARY OF THE INVENTION

Accordingly, it is a primary object of the present invention to provide an improved workpiece grinding method capable of efficiently grinding a workpiece having a cylindrical portion, a rounded corner and an end surface portion like crankshaft journals or crankpins.

Briefly, according to the present invention, there is provided a workpiece grinding method of removing a grinding allowance at at least an end surface portion of a workpiece having a cylindrical portion and the end surface portion perpendicular thereto with a grinding wheel by rotating the workpiece, by rotating the grinding wheel supported rotatably about an axis extending in parallel with the axis of the workpiece, and by moving the grinding wheel relatively to the workpiece. The method comprises a first grinding step of grinding the end surface portion to an approximately right triangle shape in section by feeding the grinding wheel from a grinding start position, where the grinding wheel overlaps the circumferential surface of the end surface portion through a width of the grinding allowance or a width narrower than the grinding allowance, toward an infeed end position on the side of the cylindrical portion in an oblique direction; and a second grinding step of removing a grinding allowance of the approximate right triangle shape in section left without being ground at the first grinding step, by feeding the grinding wheel in an approximately axial direction of the workpiece, whereby the end surface portion is ground to be approximately perpendicular to the cylindrical portion through the first and second grinding steps.

At the first grinding step, the grinding wheel is infed in the oblique direction from the grinding start position on the circumferential surface of the end surface portion toward the infeed end position on the side of the cylindrical portion. The ground surface of the end surface portion becomes an oblique surface, and the contact area thereof with the grinding wheel is decreased. This make it possible to heighten the performance of discharging grinding chips and, where coolant fluid is supplied, it becomes possible to make coolant fluid reach the grinding point reliably. Further, since the grinding wheel is fed in the oblique direction, the ground width in the axial direction of the workpiece becomes narrower as the grinding wheel comes closer to the axis of the workpiece. Accordingly, it can be realized to gradually decrease the amount ground by the shoulder portion of the grinding wheel, so that the wear of the shoulder portion of the grinding wheel can be reduced. At the second grinding step, the grinding allowance of the approximately right triangle shape left without being ground at the first grinding step is removed by the end surface portion and the shoulder portion of the grinding wheel. Therefore, although the end surface portion of the grinding wheel is brought into surface contact with the end surface portion of the workpiece during the grinding, the volume of the grinding allowance is small, and the grinding wheel contacts the end surface portion of the workpiece through a short arc in the rotational direction. Consequently, the performance of discharging the grinding chips can be prevented from being deteriorated, and the coolant fluid can reach the ground surface of the workpiece reliably.

BRIEF DESCRIPTION OF THE ACCOMPANYING DRAWINGS

The foregoing and other objects and many of the attendant advantages of the present invention may readily be appreciated as the same becomes better understood by reference to the preferred embodiments of the present invention when considered in connection with the accompanying drawings, wherein like reference numerals designate the same or corresponding parts throughout several views, and in which.

Figure 3A:
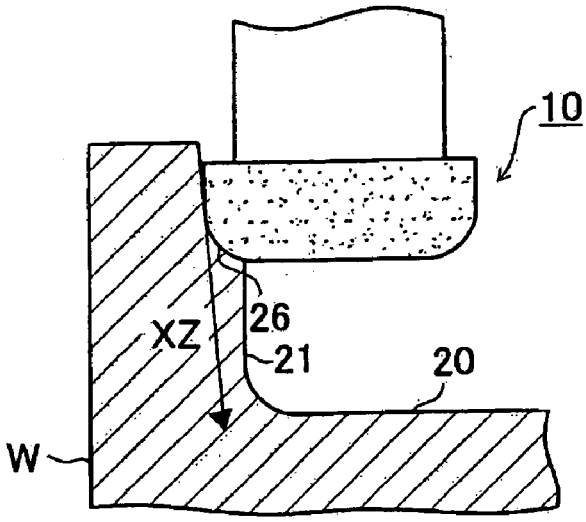
Figure 3B:
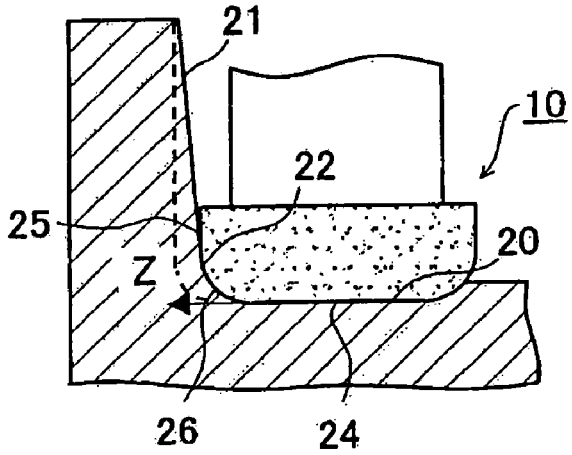
Figure 3C:
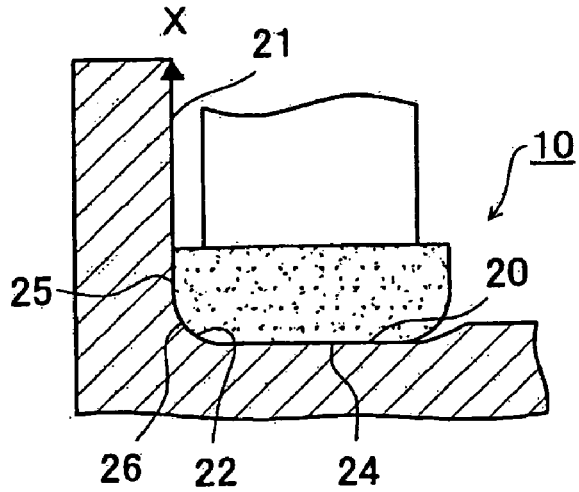
Figure 4:
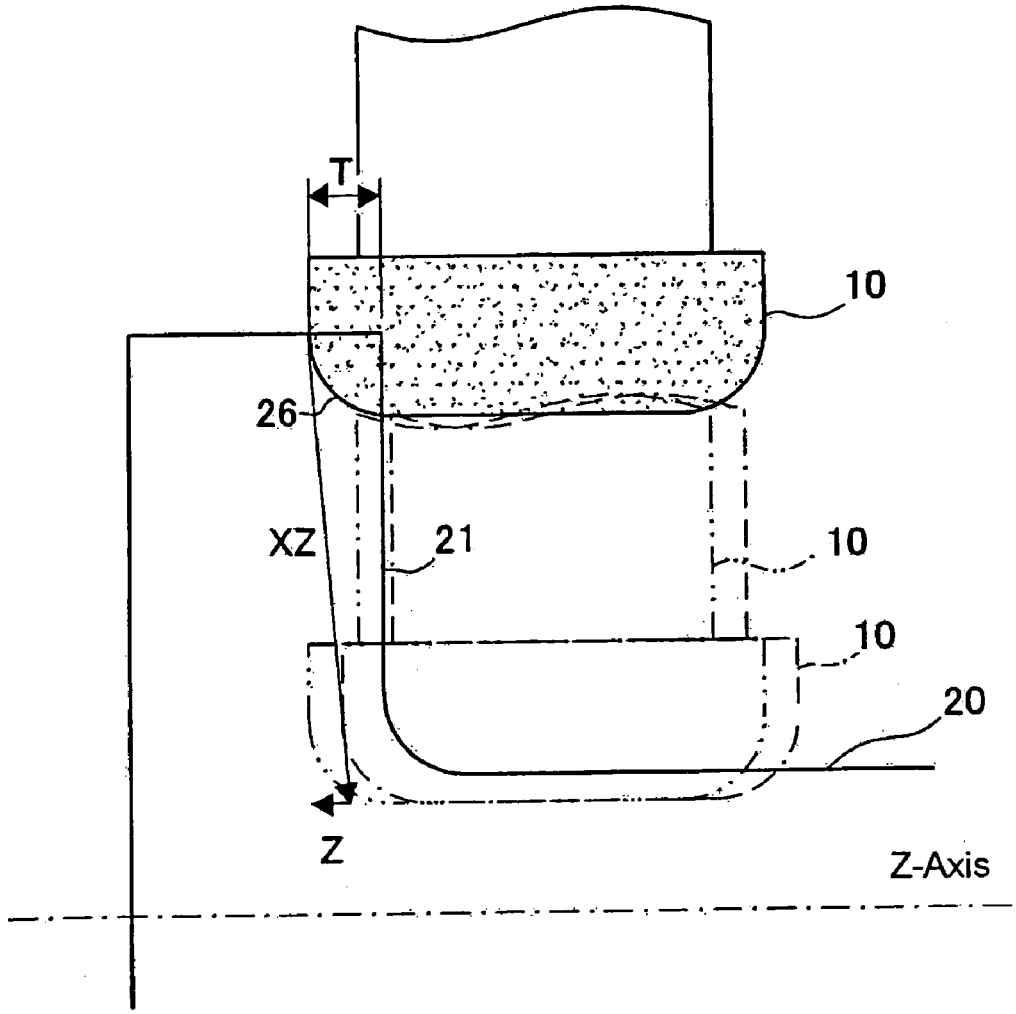
Figure 5A:
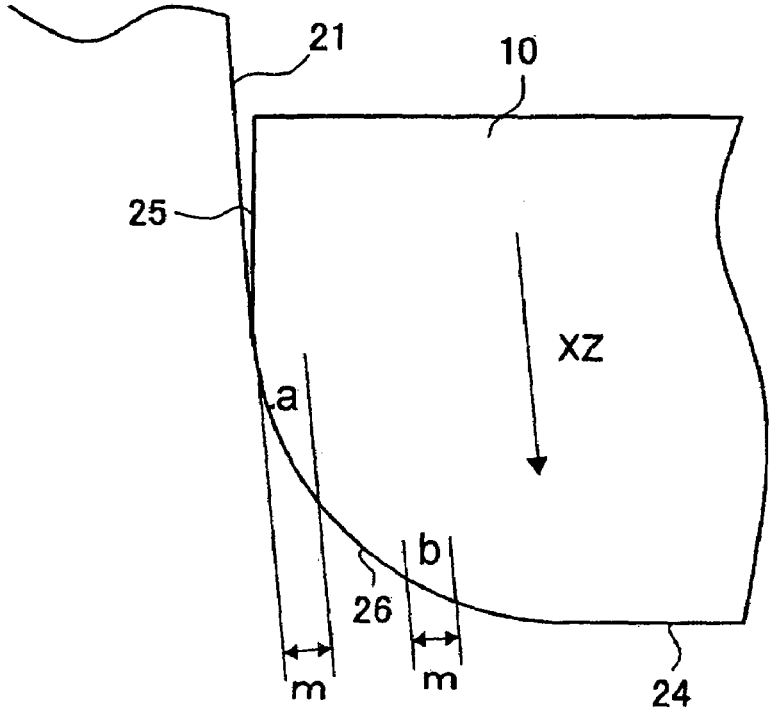
Figure 5B:
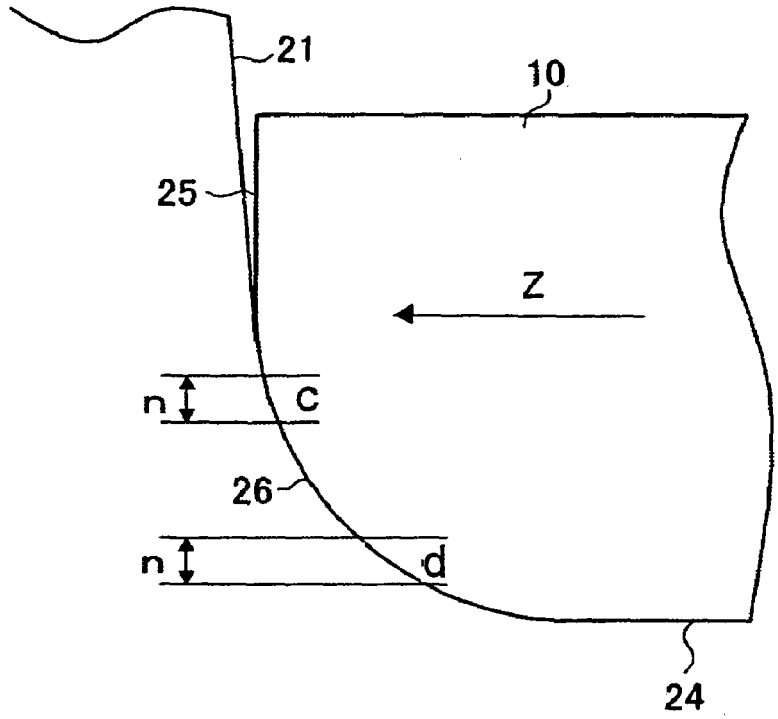
Figure 6A:
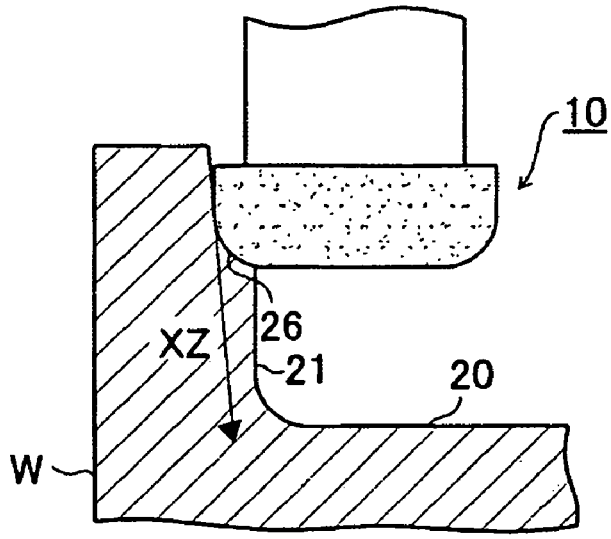
Figure 6B:
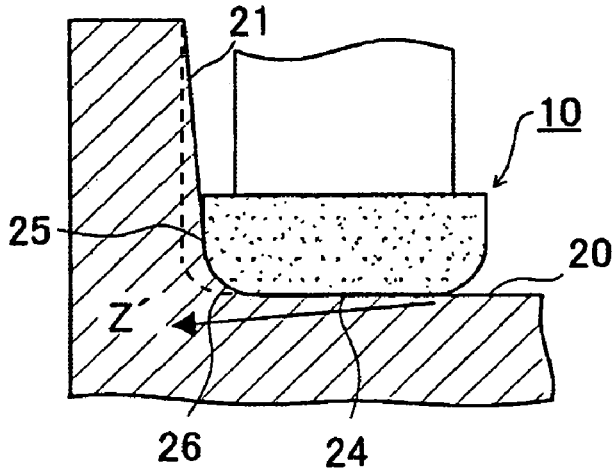
Figure 6C:
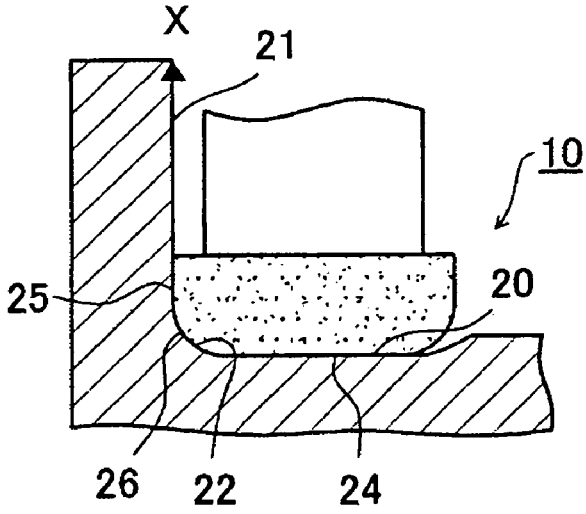
Figure 7A:
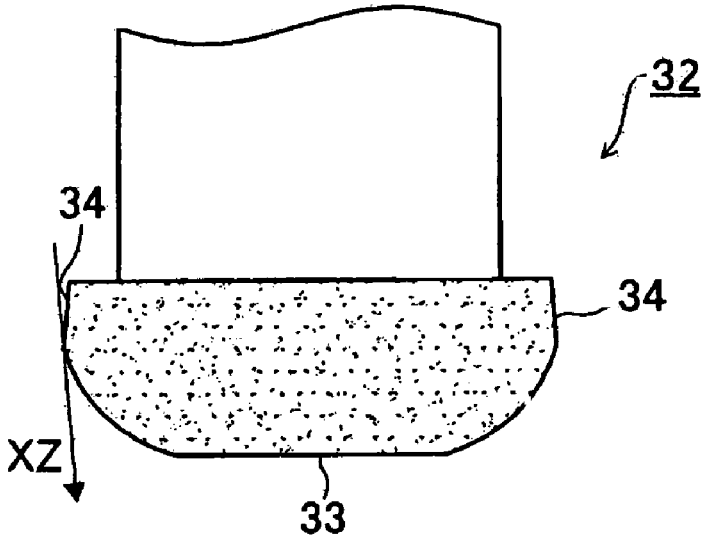
Figure 7B:
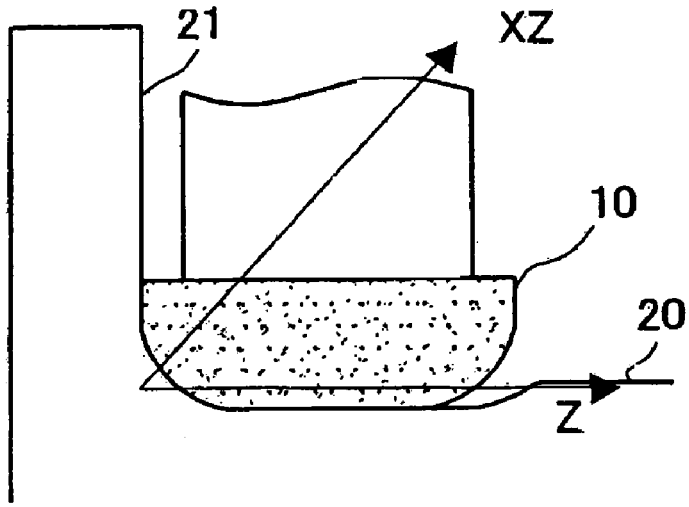
Figure 8A:
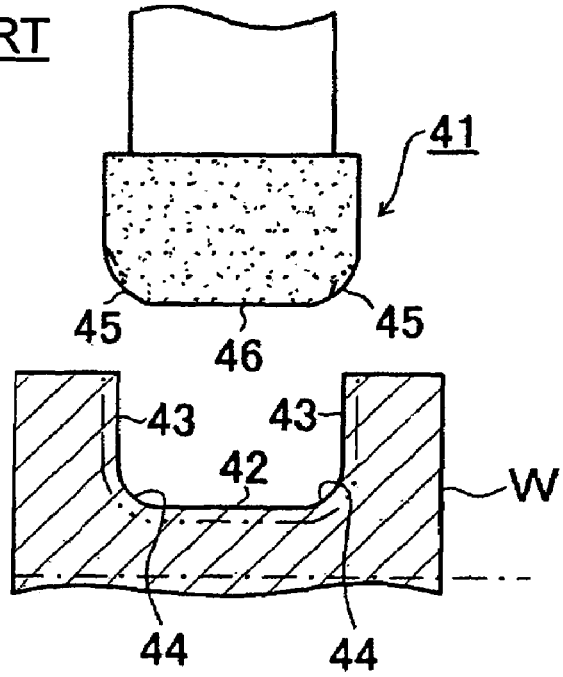
Figure 8B:
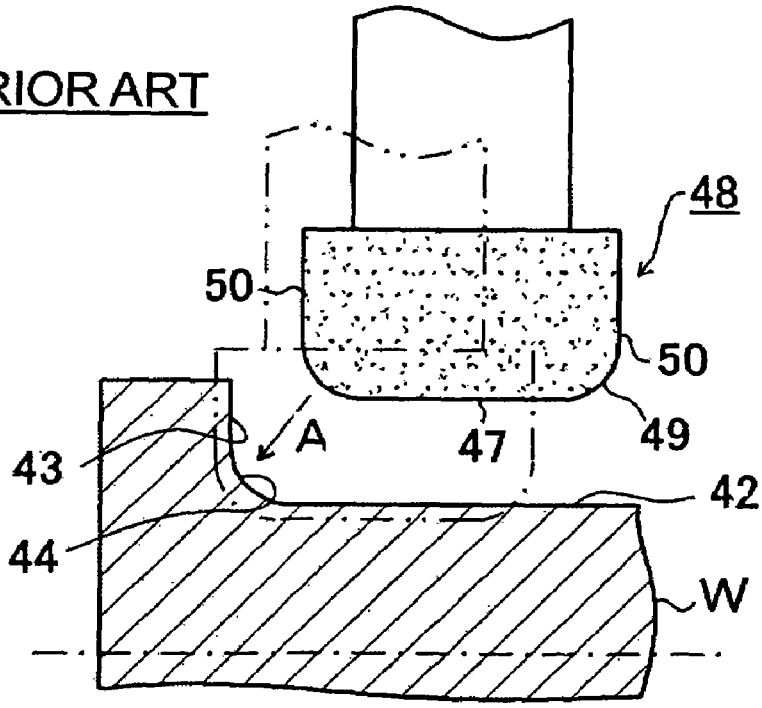

FIGS. 3(*a*) to 3(*c*) are explanatory views for explaining the flow of grinding steps in the grinding method in the first embodiment;

FIG. 4 is an explanatory view showing the position of the grinding wheel in the grinding method in the first embodiment;

FIGS. 5(*a*) and 5(*b*) are explanatory views for explaining the wear at a shoulder portion of the grinding wheel;

FIGS. 6(*a*) to 6(*c*) are explanatory views for explaining the flow of grinding steps in the grinding method in the second embodiment;

FIGS. 7(*a*) and 7(*b*) are explanatory views for respectively showing another example of the grinding wheel and a modified form of a third grinding step; and FIGS. 8(*a*) and 8(*b*) are explanatory views for respectively illustrating first and second prior art grinding methods.

DETAILED DESCRIPTION OF THE PREFERRED EMBODIMENTS

Figure 1:
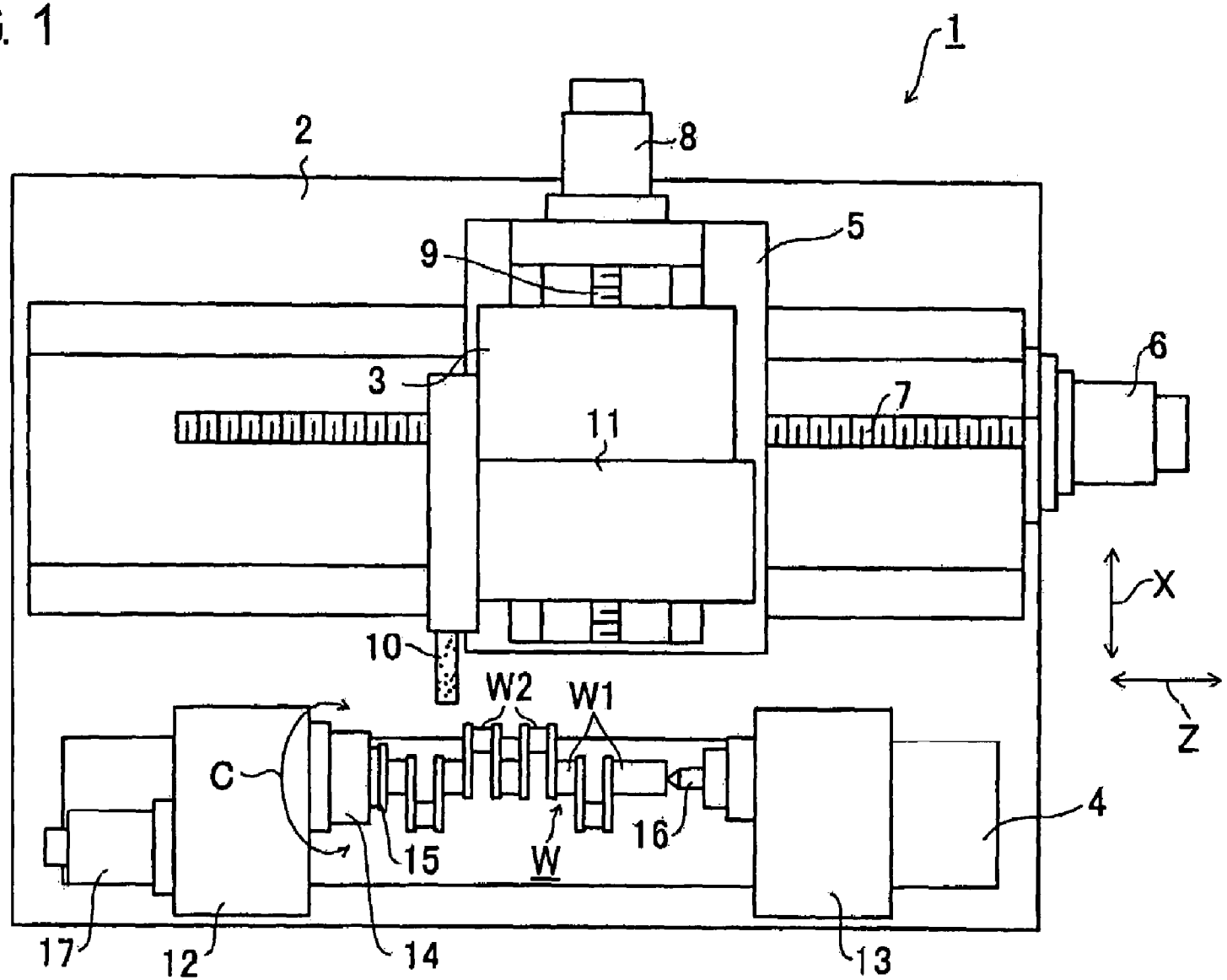
FIG. 1 is a schematic plan view of a cylindrical grinding machine used in practicing grinding methods in first and second embodiments according to the present invention.

Hereafter, a workpiece grinding method in a first embodiment according to the present invention and a cylindrical grinding machine used in practicing the method will be described with reference to FIGS. 1 to 5(*b*). FIG. 1 is a plan view showing the construction of the cylindrical grinding machine, and FIGS. 2 to 5(*b*) are explanatory views illustrating the grinding method.

First of all, the cylindrical grinding machine will be described with reference to FIG. 1. The cylindrical grinding machine 1 is provided with a bed 2 constituting a base component thereof, a wheel head 3 mounted on a top surface of the bed 2, and a table 4 mounted on the top surface of the bed 2 for supporting a workpiece W. In the grinding machine, a support slide 5 is mounted on the bed 2 to be slidable in a Z-axis direction (arrow Z) extending in parallel with the axis of the workpiece W, and the wheel head 3 is mounted on a top surface of the support slide 5 to be slidable in an X-axis direction (arrow X) extending in the radial direction of the workpiece W.

The support table 5 is moved in the Z-axis direction by a drive device 6 such as servomotor or the like whose rotational angle can be indexed precisely, through a drive transmission mechanism 7 such as feed screw mechanism or the like. On the other hand, the wheel head 3 is drivingly moved in the X-axis direction by a drive device 8 such as servomotor or the like whose rotational angle can be indexed precisely, through a drive transmission mechanism 9 such as feed screw mechanism or the like. Thus, the wheel head 3 is movable in the Z-axis direction as well as in the X-axis direction relative to the table 4. Further, the wheel head 3 rotatably supports a disc-like grinding wheel 10 and mounts thereon a drive device 11 such as motor or the like for drivingly rotating the grinding wheel 10.

The table 4 is provided with a work head 12 at one end thereof and a foot stock 13 at the other end thereof. The work head 12 is provided with a work spindle 14 which is drivingly rotated by a drive device 17 such as servomotor or the like whose rotational angle can be indexed precisely. The workpiece W is supported over the table 4, having one end thereof gripped by a chuck 15 provided on the work spindle 14 and the other end thereof pushed by a center 16 provided on the foot stock 13, and is drivingly rotatable about a C-axis (arrow C) on the rotational axis of the work spindle 14.

Figure 2:
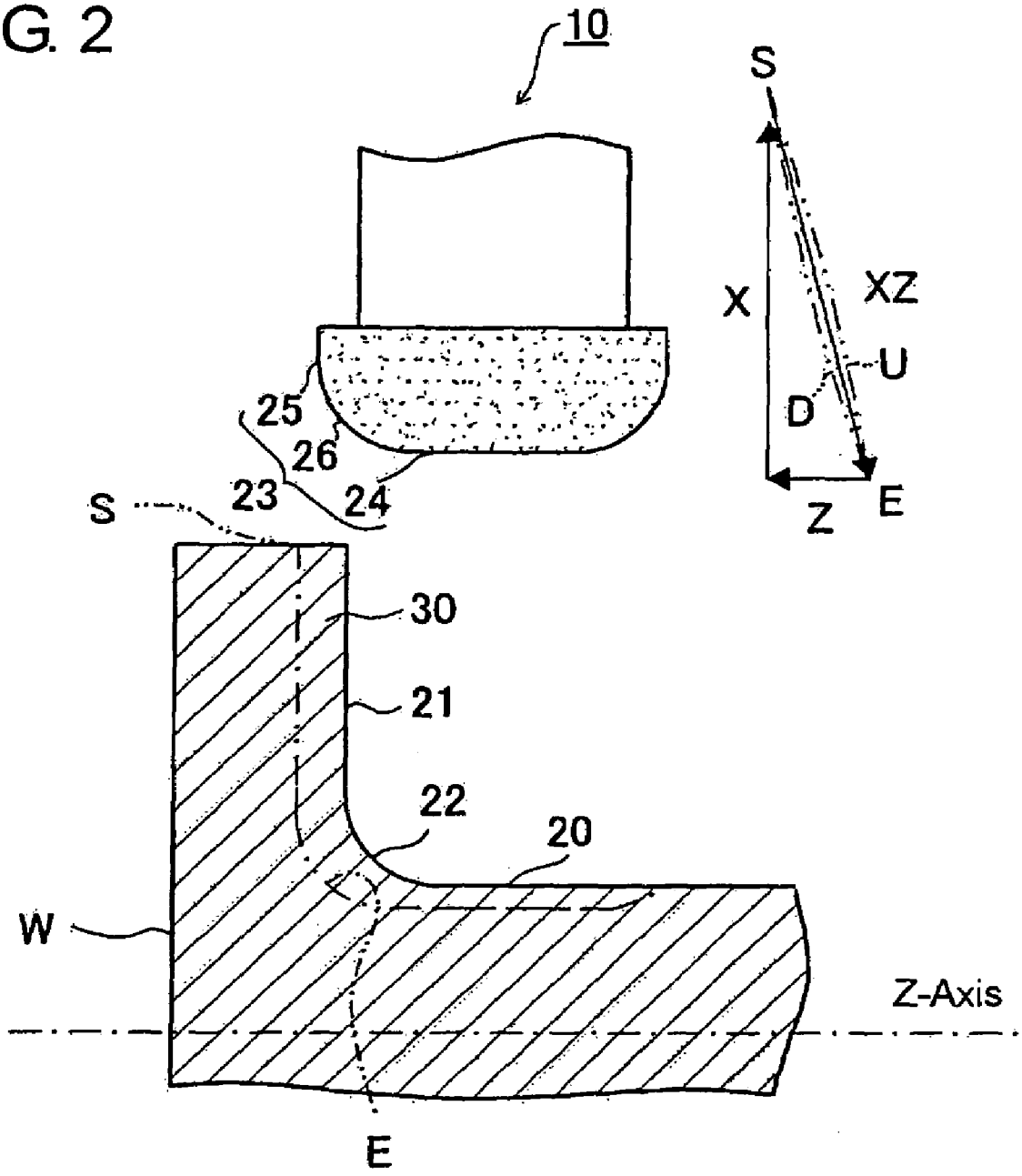
FIG. 2 is an explanatory view illustrating the grinding method in the first embodiment.

In this particular embodiment, the workpiece W is illustrated as crankshaft, and grinding object surfaces such as crank journals W1, crankpins W2 and the like are ground with the grinding wheel 10 mounted on the wheel head 3. As shown in FIG. 2, the workpiece W has been machined to a dimension with a suitable grinding allowance remaining in a preceding machining which is performed by cutting on a lath or a milling machine. The workpiece W has a cylindrical portion 20, a pair of end surface portions 21 extending perpendicularly to the axis of the cylindrical portion 20 and rounded corners 22 leading from the end surface portions 21 to both ends of the cylindrical portion 20. A shape to be finished is indicated by the two-dot-chain line in FIG. 2.

On the other hand, the grinding wheel 10 whose longitudinal section is partly shown in FIG. 2 takes a disc-like shape and is supported rotatably about its axis extending in parallel with the axis (Z-axis) of the workpiece W. The grinding wheel 10 has a circumferential surface portion 24 constituting the external surface of the grinding wheel 10, a pair of end surface portions 25 extending perpendicular to the circumferential surface portion 24 and a pair of shoulder portions 26 connecting the circumferential surface portion 24 to the end surface portions 25. The shoulder portions 26 are respectively in consistent in shape with the rounded corners 22 which the workpiece W has after being ground.

In the aforementioned cylindrical grinding machine 1, the support slide 5 is moved by the drive device 6 and the drive transmission mechanism 7 in the Z-axis direction to bring the grinding wheel 10 before a grinding object surface of the workpiece W, and then, the wheel head 3 is advanced by the drive device 8 and the drive transmission mechanism 9 toward the workpiece W, whereby the workpiece W being drivingly rotated by the drive device 17 is ground with the grinding wheel 10 being drivingly rotated by the drive device 11.

Next, the grinding method for the end surface portions 21 will be described. The left and right end surface portions 21 are ground in order in a similar grinding method. Therefore, the grinding operation will be described only for one of the end surface portions 21, and the description regarding the grinding operation for the other end surface portion 21 will be omitted for the sake of brevity.

As shown in FIGS. 2 and 3(*a*) to 3(*c*), the grinding method includes first, second and third grinding steps. At the first grinding step, the grinding wheel 10 is infed from a grinding start position (S) on the circumferential surface of the end surface portion 21 toward an infeed end position (E) on the side of the cylindrical surface portion 20 in an oblique direction, as shown in FIG. 3(*a*). Since the infeed in the oblique direction is attained by simultaneously controlling the two axes in the X-axis direction and the Z-axis direction, the oblique direction is defined as an XZ-direction herein. Thought being not limited in particular, the oblique angle of the XZ direction is set to make an angle of 0.01 degree with respect to the X-axis direction in this particular embodiment. (For the illustration purpose, the oblique angle is illustrated in a larger scale than the actual angle.) The grinding start position S in the axial direction of the workpiece W may be a position where the end surface portion 25 on the left side of the grinding wheel 10 is in alignment with the end surface portion 21 on the left side to be finished of the workpiece W or may be another position where the end surface portion 25 on the left side of the grinding wheel 10 recedes from the end surface portion 21 on the left side to be finished of the workpiece W to have a shorter or shallower grinding width in the axial direction. That is, since the whole surface of the end surface portion 21 will be finished at the second grinding step referred to later, it is sufficient to let a certain depth or width left without being ground on the end surface portion 21 at the first grinding step.

As described above, at the first grinding step, since the shoulder portion 26 of the grinding wheel 10 is infed into the end surface portion 21 of the workpiece W in the XZ-direction, the ground surface of the end surface portion 21 becomes an oblique surface and thus, is decreased in the contact area with the grinding wheel 10. That is, as shown in FIG. 3(*a*), the grinding is carried out with a clearance formed on the side of the circumferential surface of the grinding point. Therefore, the performance for discharging the grinding chips can be enhanced, and where coolant fluid is supplied, the same can be delivered reliably to the grinding point.

Further, as shown in FIG. 4, since the grinding wheel 10 is feed in the oblique direction, the grinding width (T) in the axial direction of the workpiece W is narrowed as the grinding point comes close to the axis of the workpiece W (i.e., Z-axis). Accordingly, it can be realized to reduce the wear of the shoulder portion 26 by gradually decreasing the grinding amount which is removed by the shoulder portion 26 of the grinding wheel 10. More specifically, at the first grinding step wherein the grinding wheel 10 is fed in the XZ-direction, the shoulder portion 26 is used to perform the grinding. However, as shown in FIG. 5(*a*), of the shoulder portion 26, a part (b) on the side of the circumferential surface portion 24 has a smaller number of effective abrasive grains (the number of operating abrasive grains per unit axial width (m)) than a part (a) on the side of the end surface portion 25 does, and thus, is liable to be worn. In the present embodiment, however, because the grinding width (T) in the axial direction becomes narrower as the grinding point comes closer to the axis of the workpiece W, the grinding amount removed by the part (b) on the side of the circumferential surface portion 24 gradually decreases with the infeed movement of the grinding wheel 10 in the XZ-direction. In other words, the wear of the abrasive grains is suppressed at the part (b) having a smaller number of the effective abrasive grains.

When the grinding wheel 10 reaches the infeed end position (E) shown in FIG. 3(*b*) as a result of being infed in the XZ-direction, the external surface of the cylindrical portion 20 is ground by the circumferential surface portion 24 of the grinding wheel 10, in which state a grinding allowance of an approximately right triangle shape in longitudinal section is left at the end surface portion 21 without being ground, as indicated by the broken line in FIG. 3(*b*).

At the second grinding step, the grinding wheel 10 is fed from the infeed end position (E) in the axial direction (Z-axis direction). Thus, the grinding allowance of the approximately right triangle shape in longitudinal section which is left at the end surface portion 21 without being ground is removed by the end surface portion 25 and the shoulder portion 26 of the grinding wheel 10, and the rounded corner 22 is ground between the cylindrical portion 20 and the end surface portion 21, as shown in FIG. 3(*c*). In particular, since the grinding wheel 10 is fed from the infeed end position (E) in the axial direction at this second grinding step, there can be obtained a smooth surface at the boundary of the rounded corner 22 to the cylindrical portion 20 of the grinding wheel W. Needless to say, as the grinding wheel 10 is fed in the axial direction while being rotated, the end surface portion 21 can be ground over the enter surface thereof at the second grinding step, as shown in FIG. 3(*c*).

At the second grinding step, the end surface portion 25 of the grinding wheel 10 is brought into surface contact with the end surface portion 21 of the workpiece W, but the grinding allowance at the end surface portion 21 is the approximately right angle shape in longitudinal section. Thus, a contact arc on which the grinding wheel 10 is brought into contact with the end surface portion 21 of the workpiece W is made shorter in the length in the rotational direction. That is, the area of the end surface portion 21 which is brought into contact with the grinding wheel 10 when the same is rotated through one turn is made to be smaller in comparison with that in the case that the end surface portion 21 is ground in flat contact with the grinding wheel 10. Accordingly, it can be realized to suppress the deterioration in the chip discharging performance, and it becomes easier to make coolant fluid reach the ground surface of the workpiece W.

Further, as shown in FIG. 4, the rounded corner 22 is ground when the grinding wheel 10 is fed in the axial direction. In this case, as shown in FIG. 5(*b*), of the shoulder portion 26 of the grinding wheel 10, a part (c) on the side of the end surface portion 25 has a smaller number of effective abrasive grains (the number of operating abrasive grains per unit radial width (n)) than a part (d) on the side of the circumferential surface portion 24 does. However, in the present embodiment, since the grinding allowance of the approximately right triangle shape is removed at the second grinding step, the contact arc in the rotational direction on which the grinding wheel 10 is brought into contact with the end surface portion 21 is made shorter at the part (c) on the side of the end surface portion 25 than at the part (d) on the side of the circumferential surface portion 24. That is, also in this case, the wear of the abrasive grains is suppressed at the part (c) which is smaller in the number of the effective abrasive grains than the part (d). In this way, at either of the first and second grinding steps, it can be realized to reduce the grinding amount at the part (b or c) which is fewer in the number of the effective abrasive grains, and hence, it can also be realized to distribute or even the wear of abrasive grains.

Further, in the present embodiment, a high efficiency grinding is realized by setting the infeed rate of the grinding wheel at the first grinding step to a relatively high speed which allows grinding burn to be made on the surface of the workpiece W to some extent. On the other hand, the feed rate at the second grinding step is set to a relatively slow speed for securing a surface roughness for finish, so that it can be realized to remove any grinding burn layer at the second grinding step even if any such grinding burn layer is made at the first grinding step. As known in the art, the depth of the deteriorated layer in grinding relates to the contact arc length of the grinding wheel 10 with the workpiece W as well as to the grinding efficiency. Where the grinding wheel 10 is fed obliquely as is done in the present embodiment, the change of the contact arc length depending on the position of the grinding point in the radial direction can be neglected because an approximate point contact is made between the grinding wheel 10 and the workpiece W, but the grinding efficiency changes in dependence on the position of the grinding point in the radial direction. For this reason, in the present embodiment, the grinding efficiency is made to be constant by controlling the feed rate of the grinding wheel 10 to be slower when the grinding point remains at large radial positions and by controlling the feed rate of the grinding wheel 10 to be faster with the decrease in the radial position of the grinding point. In a modified form, the grinding efficiency may be controlled not by changing the feed rate, but by changing the rotational speed of the workpiece W.

The load on the abrasive grains is expressed by the value of g/a (g: the maximum infeed depth of the abrasive grains, a: an average grain-to-grain interval in the circumferential direction). Where the value is large, the abrasive grains are liable to be subjected to abrasion, fragmentation or fall thereby to bring about the wear of the grinding wheel. Where the value becomes small conversely, there occurs a slip phenomenon in which the abrasive grains are unable to be infeed into the workpiece W, so that the wear of the abrasive grains results from heat generation and the slip phenomenon. The value of g/a is calculated from the circumferential speeds of the workpiece and the grinding wheel at the grinding point, the radial position of the grinding point and the diameter of the grinding wheel. That is, the value of g/a varies in dependence on the radial position of the grinding point. Therefore, in the present invention, in order to keep the value of g/a constant irrespective of changes in the radial position of the grinding point, control is performed to make the rotational speed of the workpiece W slower when the grinding point remains at large positions in the radial direction and to make the rotational speed of the workpiece W faster with the decreases in the radial position of the grinding point. In an alternative form, the value of g/a is controllable by changing not the rotational speed of the workpiece W, but the feed rate of the grinding wheel 10.

At the third grinding step, the grinding wheel 10 is retracted in the X-axis direction. With this step, the grinding wheel 10 gradually decreases the pressuring force on the end surface portion 21 of the workpiece W while smoothening the finished surface of the end surface portion 21. This suppresses the spring-back of the end surface portion 21, so that it becomes possible to secure the perpendicularity of the end surface portion 21.

As described above, in the aforementioned grinding method, the wear of the grinding wheel layer is distributed by performing in turn the first and second grinding steps in which the feed directions are different from each other, so that it can be realized to suppress the local wear of the grinding wheel 10. Further, the contact area of the grinding wheel 10 is made smaller at either of the grinding steps, which results in enhancing the performance of discharging grinding chips and the cooling performance with coolant fluid or the like. Consequently, it becomes possible to heighten the grinding efficiency without frequent repetition of truing operations.

Particularly, the foregoing grinding method differs from the grinding method in which the grinding wheel is fixedly inclined as is the case of a so-called angle slide grinding. Thus, even where the workpiece W having the end surface portions 21 at the both ends of the cylindrical portion 20 is used as an object to be ground as is the case of the present embodiment, the first and second grinding steps can be executed by setting the width of the grinding wheel 10 taking the account of a space between the pair of the end surface portions 21, so that either of the end surface portions 21 can be ground to be substantially perpendicular to the cylindrical portion 20.

(Second Embodiment)

Next, a workpiece grinding method in the second embodiment according to the present invention will be described with reference to FIGS. 6(*a*) to 6(*c*). The grinding method in the preset embodiment is practiced by the use of the cylindrical grinding machine 1 as used in the grinding method in the aforementioned first embodiment, and is composed of first, second and third grinding steps. The third grinding step of this second embodiment is the same as that of the grinding method in the first embodiment, and thus, the following description will be made regarding the first and second grinding steps.

At the first grinding step, as shown in FIG. 6(*a*), the grinding wheel 10 is infed in the oblique direction from the grinding start position (S) on the circumferential surface of the end surface portion 21 toward an infeed end position on the side of the cylindrical portion 20. The grinding start position (S) may be a position where the end surface portion 25 on the left side of the grinding wheel 10 is in alignment with the end surface portion 21 on the left side to be finished of the workpiece W or may be another position where the end surface portion 25 on the left side of the grinding wheel 10 recedes from the end surface portion 21 on the left side to be finished of the workpiece W to have a short or shallow grinding width in the axial direction. That is, since the whole surface of the end surface portion 21 will be finished at the second grinding step referred to later, it is sufficient to let a depth or width left without being ground on the end surface portion 21 at the first grinding step. On the other hand, as shown in FIG. 6(*b*), the infeed end position (E) is set to be a position immediately before the external surface of the cylindrical portion 20 begins to be ground. That is, the infeed end position (E) is set as the position where the end surface portion 21 is ground obliquely with the external surface of the cylindrical portion 20 being not ground.

As described above, at the first grinding step, the shoulder portion 26 is infed relative to the end surface portion 21 in the XZ-direction, and the grinding is terminated immediately before the grinding wheel 10 comes into contact with the external surface of the cylindrical portion 20. Therefore, in the second embodiment, it can be realized in addition to the functions and advantages of the grinding method in the first embodiment, to enhance the feed rate of the grinding wheel 10 at all times, so that it becomes possible to realize a high efficiency grinding. Namely, in the grinding method of the first embodiment, a problem arises in that the entire grinding time is extended because the infeed rate of the grinding wheel 10 has to be lowered at the time point when the grinding of the cylindrical portion 20 begins, to avoid the large increase of the grinding load in grinding the external surface of the cylindrical portion 20, whereas in the second embodiment, it becomes possible to infeed the grinding wheel 10 at the high feed rate until the time point when the first grinding step is terminated (i.e., throughout the first grinding step).

At the second grinding step, on the other hand, the grinding wheel 10 is fed from the infeed end position (E) in a direction inclined at an acute angle with respect to the axial direction (i.e., an inclined Z-axis direction: Z'-direction). Thus, simultaneous grindings are performed on the end surface portion 21 having a grounding allowance of the approximately right triangular shape in longitudinal section which is left without being ground at the first grinding step, as well as on the external surface of the cylindrical portion 20, and a grinding is further performed on the rounded corner 22 between the cylindrical portion 20 and the end surface portion 21, as shown in FIG. 6(*c*). In this way, since the external surface of the cylindrical portion 20 is ground at the same time as the grinding of the grinding allowance of the approximately right triangle shape in longitudinal section, it can be realized to shorten the entire grinding time.

(Other Embodiments or Modifications)

Although the grinding methods of the first and second embodiments are described as the method wherein the grinding wheel 10 is fed along a straight line when fed in the XZ-direction at the first grinding step, it may be fed along either one of curved lines (U) and (D) defined by quadratic functions, as indicated by the two-dot-chain lines in FIG. 2. In the case of the curved line (U), it becomes possible to further suppress the wear of the grinding wheel 10 at the first grinding step, whereas in the case of the curved line (D), it becomes possible to further suppress the wear of the grinding wheel 10 at the second grinding step. Therefore, if either one of the curved lines (U) and (D) is chosen based on respective grinding amounts, the respective degrees of the grinding wheel wear or the like at the first and second grinding steps, it can be realized to further extend the service life of the grinding wheel 10.

Further, although the grinding methods of the first and second embodiments are described as the example which uses the grinding wheel 10 having the end surface portions 25 formed to be perpendicular to the circumferential surface portion 24, there may be used a grinding wheel 32 whose each end surface portion 34 is formed to have a back tapered surface (a surface inwardly inclined toward the rotational axis of the grinding wheel 32) relative to a circumferential surface portion 33, as shown in FIG. 7(*a*). In this modified case, the clearance between the ground surface on the end surface portion 21 of the workpiece W and the end surface portion 34 of the grinding wheel 32 is further enlarged, so that the performance of discharging the grinding chips or the like can be further enhanced.

In addition, although the grinding methods of the first and second embodiments are described as one in which the grinding wheel 10 is retracted in the X-axis direction at the third grinding step, the methods may be modified to retract the grinding wheel 10 in an inclined direction (i.e., XZ-direction) without moving the grinding wheel 10 along the surface of the end surface portion 21, as shown in FIG. 7(*b*). In the modified methods, it becomes possible to separate the grinding wheel 10 immediately from the surface of the end surface portion 21, so that the entire machining time can be further shortened. In a further modified form, the grinding wheel 10 may be retracted away from the end surface portion 21 in the Z-axis direction. In this further modified method, a part left without being ground of the external surface of the cylindrical portion 20 can be ground in succession to the grinding of the end surface portion 21.

Various features and many of the attendant advantages in the foregoing embodiments will be summarized as follows:

In the workpiece grinding method in the first embodiment typically shown in FIGS. 2 and 3(*a*) to 3(*c*), the first and second grinding steps (FIGS. 3(*a*) and 3(*b*)) are performed in order. At the first grinding step (FIG. 3(*a*)), the workpiece W and the grinding wheel 10 are rotated, and the grinding wheel 10 is infed in the oblique XZ-direction from the grinding start position (S) on the circumferential surface of the end surface portion 21 toward the infeed end position (E) on the side of the cylindrical portion 20. Since the shoulder portion 26 of the grinding wheel 10 is infed into the end surface portion 21 in the oblique direction, the ground surface of the end surface portion 21 becomes an oblique surface, and the contact area thereof with the grinding wheel 10 is decreased. This makes it possible to heighten the performance of discharging grinding chips, and where coolant fluid is supplied, it becomes possible to make the coolant fluid reach the grinding point reliably. Since the grinding wheel 10 is fed in the oblique direction, the ground width (T) in the axial direction of the workpiece W becomes narrower as the grinding wheel 10 comes closer to the axis of the workpiece W. Accordingly, it can be realized to gradually decrease the amount ground by the shoulder portion 26 of the grinding wheel 10, so that the wear of the shoulder portion 26 of the grinding wheel 10 can be reduced.

At the second grinding step, the grinding allowance of the approximately right triangle shape left without being ground at the first grinding step is removed by the end surface portion 25 and the shoulder portion 26 of the grinding wheel 10. Where the grinding start position (S) at the first grinding step is set to remove the grinding allowance of a shorter (or shallower) width on the circumferential surface of the end surface portion 21 than the predetermined width (T) (i.e., the width defining a finished end surface), that is, where an allowance is left also on the circumferential surface of the end surface portion 21, the grinding at the second grinding step is performed to remove such an allowance at the same time.

At the second grinding step, the grinding allowance is the approximately right triangle shape in longitudinal section. Therefore, although the end surface portion 25 of the grinding wheel 10 is brought into surface contact with the end surface portion 21 of the workpiece W during the grinding, the volume of the grinding allowance is small, and the grinding wheel 10 contacts the end surface portion 21 of the workpiece W through a short arc in the rotational direction. Consequently, the performance of discharging the grinding chips can be prevented from being deteriorated, and the coolant fluid can reach the ground surface of the workpiece W reliably.

Further, since the directions in which the grindings proceed at the first and second grinding steps become opposite, the wear of the grinding layer of the grinding wheel 10 is distributed to suppress the local wear on the grinding wheel 10.

The "grinding wheel" as employed in the present invention may be one which has grinding layers at least at the shoulder portion 26 and the end surface portion 25 thereof. The shoulder portion 26 may take the shape of a right angle or a rounded (R) corner. Further, the first grinding step may be performed to grind both of the end surface portion 21 and the cylindrical portion 20 of the workpiece W or to grind the end surface portion 21 only. The "approximately axial direction" means a roughly axial direction, and in its scope, encompasses the oblique direction which is slightly inclined with respect to the axis of the workpiece W.

In addition, when fed in the oblique direction at the first grinding step, the grinding wheel 10 may be fed along the straight line (XZ) or may be fed along the arc (D or U). That is, so far as the grinding wheel 10 is infed relative to the workpiece W to gradually decrease the grinding width (T) in the axial direction, it does not matter whether the variation in the relative infeed amount may be constant or may be changed.

Also in the workpiece grinding method in the first embodiment typically shown in FIGS. 2 and 3(*a*) to 3(*c*), at the first grinding step, the end surface portion 21 is ground to the approximately right triangle shape, and the external surface of the cylindrical portion 20 is ground by the circumferential surface portion 24 of the grinding wheel 10. At the second grinding step, the grinding wheel 10 is fed from the infeed end position (E) in the axial direction of the workpiece W. Thus, the cylindrical portion 20 and the end surface portion 21 of the workpiece W are ground, and at the same time, a portion 22 at which the end surface portion 21 intersects with the cylindrical portion 20 can be ground to have a smooth surface thereon.

In the grinding method for grinding the end surface portion 21 and the external surface of the cylindrical portion 20 at the first grinding step, since the grinding load during the grinding of the end surface portion 21 is relatively low, it becomes possible to realize a high efficiency grinding by increasing the infeed rate of the grinding wheel 10. On the other hand, since the ground width on the external surface of the cylindrical portion 20 is large, the grinding load increases greatly upon the grinding starting on the cylindrical portion 20, so that it is difficult to heighten the feed rate of the grinding wheel 10. For this reason, at the first grinding step, it is likely that the entire grinding time may be elongated because the feed rate of the grinding wheel 10 has to be lowered at the time point when the cylindrical portion 20 begins to be ground.

To solve this problem, in the workpiece grinding method in the second embodiment typically shown in FIGS. 6(*a*) to 6(*c*), the infeed end potion (E) at the first grinding step is set to be a position where the external surface of the cylindrical portion 20 begins to be ground, and at the second grinding step, the grinding wheel 10 is fed from the infeed end position (E) in a direction inclined relative to the axial direction of the workpiece W to simultaneously grind the grinding allowance of the approximately right triangle shape in longitudinal section left without being ground at the first grinding step and the external surface of the cylindrical portion 20. In this method, since the infeed end potion (E) at the first grinding step is set to be a position where the external surface of the cylindrical portion 20 begins to be ground, the first grinding step is terminated at the time point when the end surface portion 21 is ground to the approximately right angle shape in longitudinal section without grinding the external surface of the cylindrical portion 20. Thus, it becomes possible at the first grinding step to realize a high efficiency grinding by keeping the feed rate of the grinding wheel 10 high throughout the first grinding step. At the second grinding step, on the other hand, the grinding wheel 10 is fed from the infeed end position (E) in the direction inclined relative to the axial direction of the workpiece W. As a result, grindings are performed on the approximately right triangle shape in longitudinal section left without being ground at the first grinding step and the external surface of the cylindrical portion 20, and the portion 22 where the end surface portion 21 intersects with the cylindrical portion 20 can be ground to be a smooth surface. Further, since the external surface of the cylindrical portion 20 is ground at the same time as the grinding allowance of the approximately right angle shape is ground, the entire machining time taken for the grinding can be shortened. Also at the second grinding step, the feed rate of the grinding wheel 10 is set to be low from the beginning for the finish grinding on the entire part of the end surface portion 21, a problem such as grinding burn or the like does not arise even when the grinding load increases with the grinding of the external surface of the cylindrical portion 20.

In either of the first and second embodiments, it is preferable that the workpiece W to be ground has the rounded corner 22 between the end surface portion 21 and the cylindrical portion 20 and that the grinding wheel 10 has the shoulder portion 26 which corresponds in sectional shape to the rounded corner 22. In this case, the grinding wheel 10 having at its shoulder portion 26 a grinding layer which corresponds in sectional shape to the rounded corner 22 is used to grind the rounded corner 22 at the second grinding step. Thus, it can be realized to grind the cylindrical portion 20 and the end surface portion 21 and to grind the rounded corner 22 to a smooth surface.

At the first grinding step in each of the first and second embodiments, the grinding is performed by the shoulder portion 26 whose shape in section corresponds to the rounded corner 22, and the shoulder portion 26 is liable to be worn because, of the shoulder portion 26, the part (b) on the circumferential surface side is fewer in the number of the effective abrasive grains than the part (a) on the end surface side. However, as shown in FIG. 4, in the grinding methods of the first and second embodiments, since the grinding width (T) in the axial direction is made to be narrower as the grinding wheel 10 comes close to the axis of the workpiece W, the grinding amount removed by the part (b) on the circumferential surface side decreases with the feeding of the grinding wheel 10. This results in suppressing the wear of the part (b) at which the number of the effective abrasive grains is smaller. At the second grinding step, on the other hand, of the shoulder portion 26, the part (c) on the end surface side is smaller in the number of the effective abrasive grains than the part (d) on the circumferential surface side, as shown in FIG. 5(*b*). However, in the present embodiments, since the grinding allowance of the approximately right triangle shape in longitudinal section is removed at the second grinding step, the length in the rotational direction of the arc on which the grinding wheel 10 contacts the end surface portion 21 is shorter on the end surface side than on the circumferential surface side. Thus, also at the second grinding step, the wear of the part (c) at which the effective abrasive grains are smaller in number can be suppressed, whereby it becomes possible to distribute or even the wear of the grinding wheel 10.

In either of the first and second embodiments, it is preferable that the workpiece W to be ground has the pair of end surface potions 21 at both ends of the cylindrical portion 20 and that the first and second grinding steps are performed in order for each of the end surface portions 21. In this case, the "workpiece" W is not limited to any particular one, but may be exemplified as a crankshaft.

In these embodiments, the first and second grinding steps are performed in order for each of the end surface portions 21, and each of the end surface portions 21 can be ground to be approximately perpendicular to the cylindrical portion 20. Being different from a grinding wheel which is set with the rotational axis inclined for use in angle slide grinding, the grinding wheel 10 in the embodiments can be used in practicing the first and second grinding steps between the pair of the end surface portions 21 narrow in axial space where the width of the grinding wheel 10 is set taking account of the narrow space between the end surface portions 21.

Also in either of the first and second embodiments, it is preferable that the feed rate of the grinding wheel 10 at the first grinding step is set to be faster than the feed rate of the grinding wheel 10 at the second grinding step. In this case, although the feed rate of the grinding wheel 10 at the second grinding step is restricted to secure a surface roughness for finish, a high efficiency grinding can be realized by increasing the feed rate at the first grinding step. Since the whole part of the end surface portion 21 is ground to be finished at the second grinding step, any grinding burn layer which may be generated at the first grinding step can be removed at the second grinding step.

Also in either of the first and second embodiments, as shown in FIG. 2, it is possible to set to the straight line (XZ) the locus along which the grinding wheel 10 is infed from the grinding start position (S) to the infeed end position (E) at the first grinding step. In this case, it can be realized by the utilization of a relatively simple control method to feed the grinding wheel 10 in the oblique direction (XZ).

Also in either of the first and second embodiments, as shown in FIG. 2, it is possible to set the locus along which the grinding wheel 10 is fed from the grinding start position (S) to the infeed end position (E) at the first grinding step, to the curved line (D or U) determined based on an arbitrary function or the like. In this case, it becomes possible to perform a further preferred grinding operation. For example, where the feed locus of the grinding wheel 10 is set to be a quadratic curve, it can be realized to further suppress the wear of the grinding wheel 10 at the first grinding step, so that the service life of the grinding wheel 10 can be further extended.

As described above, in the workpiece grinding method according to the present invention, the contact area of the grinding wheel 10 with the workpiece W at the first and second grinding steps is made smaller, so that it can be realized to enhance the performance of discharging the grinding chips and the cooling performance using coolant fluid or the like. Accordingly, it can be realized to heighten the grinding efficiency without repetitively performing frequent truing operations on the grinding wheel 10. In addition, by successively performing the first and second grinding steps at which the feed directions of the grinding wheel 10 are different from each other, the wear of the grinding wheel layer is distributed, so that the wear of the grinding wheel 10 can be suppressed.

Obviously, further numerous modifications and variations of the present invention are possible in light of the above teachings. It is therefore to be understood that within the scope of the appended claims, the present invention may be practiced otherwise than as specifically described herein.

What is claimed is:

1. A workpiece grinding method of removing a grinding allowance at at least an end surface portion of a workpiece having a cylindrical portion and the end surface portion perpendicular thereto with a grinding wheel by rotating the workpiece, by rotating the grinding wheel supported rotatably about an axis extending in parallel with the axis of the workpiece, and by moving the grinding wheel relatively to the workpiece, the method comprising:

a first grinding step of grinding the end surface portion to an approximately right triangle shape in section by feeding the grinding wheel from a grinding start position, where the grinding wheel overlaps the circumferential surface of the end surface portion through a grinding width of the grinding allowance or a grinding width narrower than the grinding allowance, toward an infeed end position on the side of the cylindrical portion in an oblique direction in which the grinding width of the end surface portion in the direction parallel to the axis of the workpiece which is ground in the first grinding step is narrowed as the grinding wheel approaches the infeed end position; and a second grinding step of removing a grinding allowance of the approximate right triangle shape in section of the end surface portion left without being ground at the first grinding step, by feeding the grinding wheel in an approximately axial direction of the workpiece;

whereby the end surface portion is ground to be approximately perpendicular to the cylindrical portion through the first and second grinding steps.

2. The method as set forth in claim 1, wherein:

the infeed end position at the first grinding step is a position where the external surface of the cylindrical portion is ground; and the grinding wheel is fed from the infeed end position in the axial direction of the workpiece at the second grinding step.

3. The method as set forth in claim 1, wherein:

the infeed end potion at the first grinding step is a position immediately before the external surface of the cylindrical portion begins to be ground; and at the second grinding step, the grinding wheel is fed from the infeed end position in a direction inclined relative to the axial direction of the workpiece to simultaneously grind the approximately right triangle shape in section left without being ground at the first grinding step and the external surface of the cylindrical portion.

4. The method as set forth in claim 1, wherein:

the workpiece to be ground has a rounded corner between the end surface portion and the cylindrical portion; and the grinding wheel has a shoulder portion which corresponds in sectional shape to the rounded corner.

5. The method as set forth in claim 1, wherein:

the workpiece to be ground has a pair of end surface potions at both ends of the cylindrical portion; and the first and second grinding steps are performed in order for each of the end surface portions.

6. The method as set forth in claim 1, wherein:

the feed rate of the grinding wheel at the first grinding step is set to be faster than the feed rate of the grinding wheel at the second grinding step.

7. The method as set forth in claim 1, wherein:

a locus along which the grinding wheel is infed from the grinding start position to the infeed end position at the first grinding step is a straight line.

8. The method as set forth in claim 1, wherein:

a locus along which the grinding wheel is fed from the grinding start position to the infeed end position at the first grinding step is a curved line determined based on an arbitrary function.

9. The method as set forth in claim 1, further comprising a third grinding step of retracting the grinding wheel toward the grinding start position in a direction perpendicular to the axial direction while smoothing the end surface portion.

* * * * *